US007722481B2

(12) United States Patent
Kasashima et al.

(10) Patent No.: US 7,722,481 B2
(45) Date of Patent: May 25, 2010

(54) GOLF BALL

(75) Inventors: Atsuki Kasashima, Chichibu (JP); Atsushi Komatsu, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 12/033,466

(22) Filed: Feb. 19, 2008

(65) Prior Publication Data

US 2009/0209366 A1 Aug. 20, 2009

(51) Int. Cl.
*A63B 37/06* (2006.01)

(52) U.S. Cl. ..... 473/373

(58) Field of Classification Search ..... 473/373, 473/374, 376

See application file for complete search history.

(56) References Cited

U.S. PATENT DOCUMENTS

| | | | | |
|---|---|---|---|---|
| 6,565,455 | B2 * | 5/2003 | Hayashi et al. | 473/371 |
| 6,592,470 | B2 | 7/2003 | Watanabe et al. | |
| 6,656,059 | B2 | 12/2003 | Umezawa et al. | |
| 6,723,008 | B2 | 4/2004 | Higuchi et al. | |
| 6,923,735 | B1 * | 8/2005 | Hayashi | 473/376 |
| 7,084,198 | B2 | 8/2006 | Takesue et al. | |
| 7,270,612 | B2 | 9/2007 | Hayashi | |
| 7,270,613 | B2 | 9/2007 | Hayashi | |
| 7,288,031 | B2 | 10/2007 | Watanabe et al. | |
| 2005/0020386 | A1 * | 1/2005 | Sasaki | 473/371 |

FOREIGN PATENT DOCUMENTS

| | | | |
|---|---|---|---|
| JP | 2001-218873 | A | 8/2001 |
| JP | 2002-85589 | A | 3/2002 |
| JP | 2002-315848 | A | 10/2002 |
| JP | 2002-345999 | A | 12/2002 |
| JP | 2003-175129 | A | 6/2003 |
| JP | 2005-211656 | A | 8/2005 |
| JP | 2005-218858 | A | 8/2005 |
| JP | 2005-218859 | A | 8/2005 |
| JP | 2005-342532 | A | 12/2005 |
| JP | 2006-87948 | A | 4/2006 |
| JP | 2006-87949 | A | 4/2006 |
| JP | 2006-230661 | A | 9/2006 |

* cited by examiner

*Primary Examiner*—Raeann Trimiew
(74) *Attorney, Agent, or Firm*—Sughrue Mion, PLLC

(57) ABSTRACT

The invention provides a golf ball composed of a core, a cover having a plurality of dimples on an outside surface thereof, and an intermediate layer disposed between the core and the cover. The core has a deflection, when compressed under a final load of 130 kgf from an initial load of 10 kgf, of at least 3.0 mm but not more than 5.0 mm. The intermediate layer is formed of a highly neutralized resin material, and has a Shore D hardness of at least 40 but not more than 60 and a thickness of at least 1.7 mm but not more than 4.0 mm. The number of dimples is at least 272 but not more than 348. The golf ball, through a combination of dimples which do not cause a loss of lift in the low-velocity, low-spin rate region of the ball trajectory and a low-spin construction, travels farther and is therefore beneficial for competitive use by both skilled and amateur golfers.

8 Claims, 2 Drawing Sheets

GOLF BALL

BACKGROUND OF THE INVENTION

The present invention relates to a golf ball composed of a core, an intermediate layer and a cover having a plurality of dimples formed thereon. More specifically, the invention relates to a golf ball which, in terms of distance, scuff resistance and durability, is beneficial for competitive use by highly skilled golfers and amateur golfers.

It is known that a golf ball, when hit at a low spin rate and a high launch angle, will travel a longer distance. With recent advances in golfing gear (balls and clubs), it is no longer unusual for a ball to be hit under exceedingly low spin conditions such as a backspin of 2,000 rpm. Under such low spin conditions, the ball has a low coefficient of drag (CD), which works to increase the distance of travel. However, with conventional dimples, in the low-velocity region after the ball has passed through the highest point of its trajectory, a loss of distance occurs due to insufficient lift and the resulting drop in trajectory.

Recently, golf balls often have an internal construction with a plurality of layers. The layers enclosing the ball core typically include a cover and an intermediate layer situated between the core and the cover. Numerous disclosures (see the ten patent documents listed below) have been made in the art relating to the use of materials for forming such an intermediate layer which are based on highly neutralized polymers.

JP-A 2006-087949
JP-A 2006-087948
JP-A 2005-342532
JP-A 2005-218859
JP-A 2005-218858
JP-A 2003-175129
JP-A 2002-345999
JP-A 2002-315848
JP-A 2002-085589
JP-A 2001-218873

However, in these golf balls, the rebound sometimes decreases on account of the cover material which encloses the intermediate layer. Hence, there remains room for further improvement in the distance traveled by the ball. Moreover, the golf balls according to the above-cited prior art often have a scuff resistance and durability that leave something to be desired.

In addition, the patent documents listed below relate to golf balls which focus on the deflection or initial velocity of a sphere composed of a core encased by an intermediate-layer, although there remains room for improvement in the distance traveled by such balls.

JP-A 2006-230661
JP-A 2005-211656

SUMMARY OF THE INVENTION

It is therefore an object of the present invention to provide a golf ball which has an improved rebound and sufficiently reduces the spin rate on shots with a driver, thus increasing the distance of travel, and which also has an improved durability and scuff resistance.

The inventor, on conducting extensive investigations aimed at achieving the above object, has discovered the surprising and unanticipated fact that, in a golf ball composed of a core encased by an intermediate layer and a cover, by using a highly neutralized polymer having a high resilience as the intermediate layer-forming material in order to maintain the rebound of the ball as a whole and also using a zinc ion-type ionomer resin having a good scuff resistance but a poor resilience as the cover material, owing to synergistic effects between the intermediate layer and the cover, the durability of the ball can be improved without lowering the rebound of the ball as a whole. The inventor has also found that, when a dimple design which does not lose lift in the low-velocity, low-spin region of the ball trajectory is provided on the outside surface of a golf ball having the foregoing core/intermediate layer/cover construction at the interior, the ball structure which achieves a low spin rate on shots with a driver and the improved lift on the ball trajectory together enable the ball to travel a longer distance.

Accordingly, the invention provides the following golf balls.

[1] A golf ball comprising a core, a cover having a plurality of dimples on an outside surface thereof, and an intermediate layer disposed between the core and the cover, wherein the core has a deflection, when compressed under a final load of 130 kgf from an initial load of 10 kgf, of at least 3.0 mm but not more than 5.0 mm; the intermediate layer is formed of a material composed primarily of a heated mixture of:

100 parts by weight of a resin component composed of, in admixture, a base resin of (a) an olefin-unsaturated carboxylic acid random copolymer and/or a metal ion neutralization product of an olefin-unsaturated carboxylic acid random copolymer mixed with (b) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in a weight ratio between 100:0 and 0:100, and (e) a non-ionomeric thermoplastic elastomer in a weight ratio between 100:0 and 50:50;

(c) 5 to 150 parts by weight of a fatty acid and/or fatty acid derivative having a molecular weight of from 228 to 1500; and (d) 0.1 to 17 parts by weight of a basic inorganic metal compound capable of neutralizing un-neutralized acid groups in the base resin and component (c);

the intermediate layer has a Shore D hardness of at least 40 but not more than 60, and has a thickness of at least 1.7 mm but not more than 4.0 mm; and the number of dimples is at least 272 but not more than 348.

[2] The golf ball of [1] which has initial velocity characteristics, as defined by the Rules of Golf, that satisfy the following condition:

(initial velocity of the core)<(initial velocity of a sphere composed of the core encased by the intermediate layer).

[3] The golf ball of [1], wherein the cover is formed of a resin material which is an ionomer resin neutralized with zinc ions.

[4] The golf ball of [1], wherein the intermediate layer has a thickness of from 2.0 to 3.5 mm.

[5] The golf ball of [1], wherein the core has a deflection (I) when compressed under a final load of 130 kgf from an initial load of 10 kgf and a sphere composed of the core encased by the intermediate layer has a deflection (II) when compressed under a final load of 130 kgf from an initial load of 10 kgf such that the ratio II/I<0.9.

[6] The golf ball of [1], wherein at least 85 mol % of the acid groups in the heated mixture used in the intermediate layer-forming material are neutralized with metal ions.

The initial velocity of a golf ball core is generally a large factor in the initial velocity of the golf ball. In the present invention, by using a highly neutralized resin material in the intermediate layer and making this layer relatively thick, a lower spin rate is achieved due to the intermediate layer. In addition, a zinc-neutralized ionomer resin having excellent scuff resistance is used within the ionomer resin. In this way, a spin rate within a specific range is achieved without lowering the rebound of the ball as a whole. At the same time, dimples which do not cause a loss of lift in the low-velocity, low-spin region of the ball trajectory are employed on the ball surface, enabling the total distance traveled by the ball to be increased.

BRIEF DESCRIPTION OF THE DIAGRAMS

DETAILED DESCRIPTION OF THE INVENTION

The invention is described more fully below.

Figure 1:
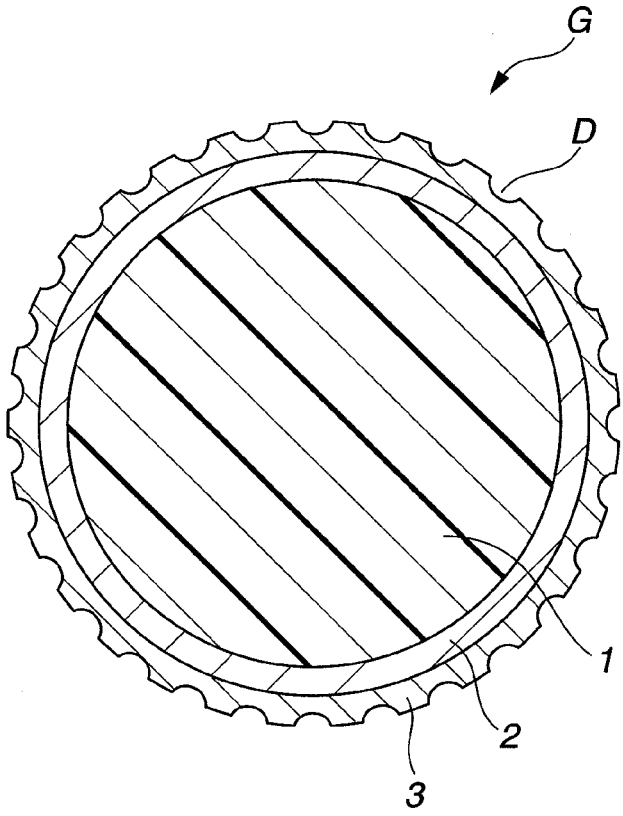
FIG. 1 is a schematic cross-sectional view showing the internal construction of a golf ball according to one embodiment of the invention.

As noted above, the present invention pertains to a golf ball having a core, a cover, and an intermediate layer situated between the core and the cover. The surface of the ball has a plurality of dimples thereon. As an embodiment of the inventive ball, FIG. 1 shows a multi-piece solid golf ball G having a core 1, a cover 3 with a plurality of dimples D thereon, and an intermediate layer 2 situated between the core 1 and the cover 3.

The core-forming material may be a rubber composition composed primarily of polybutadiene and including suitable amounts of various additives, such as an organic peroxide, an antioxidant, an inorganic filler, and an unsaturated carboxylic acid and/or a metal salt thereof. The rubber composition may be molded and vulcanized to form a crosslinked rubber material as the core, such vulcanization being carried out under conditions and by a method in general accordance with commonly known conditions and methods used for the same purpose.

The core has a diameter which, while not subject to any particular limitation, is preferably at least 30 mm but not more than 38.5 mm in cases where a three-piece golf ball is to be formed.

It is critical for the core to have a deflection, when compressed under a final load of 130 kgf from an initial load of 10 kgf, of at least 3.0 mm but not more than 5.0 mm. The lower limit in the deflection is preferably at least 3.3 mm, more preferably at least 3.5 mm, and even more preferably at least 3.8 mm. The upper limit in the deflection is preferably not more than 4.3 mm, and more preferably not more than 4.0.

The core has a surface hardness which, while not subject to any particular limitation, has a JIS-C hardness value of preferably at least 60, more preferably at least 65, and even more preferably at least 70, but preferably not more than 85, and more preferably not more than 80. The core has a center hardness which, while not subject to any particular limitation, has a JIS-C hardness value of preferably at least 50, and more preferably at least 55, but preferably not more than 65, and more preferably not more than 62. The difference therebetween (core surface hardness−core center hardness), in terms of JIS-C hardness values, is preferably at least 5 but not more than 30, and more preferably at least 10 but not more than 25. By setting the core hardness distribution (hardness difference) in the foregoing ranges, an even greater reduction in the spin rate can be achieved.

The intermediate layer is disposed between the core and the subsequently described cover. By using a material having a good resilience and finishing to a laminate of relatively high thickness, a sufficient reduction in the spin rate of the ball can be obtained, enabling the objects of the invention to be achieved. The intermediate layer is not limited to a single layer, and may instead be formed as a plurality of layers.

The intermediate layer is formed of a material composed primarily of a heated mixture of:

100 parts by weight of a resin component composed of, in admixture,

- a base resin of (a) an olefin-unsaturated carboxylic acid random copolymer and/or a metal ion neutralization product of an olefin-unsaturated carboxylic acid random copolymer mixed with (b) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in a weight ratio between 100:0 and 0:100, and
- (e) a non-ionomeric thermoplastic elastomer in a weight ratio between 100:0 and 50:50;
- (c) 5 to 150 parts by weight of a fatty acid and/or fatty acid derivative having a molecular weight of from 228 to 1500; and
- (d) 0.1 to 17 parts by weight of a basic inorganic metal compound capable of neutralizing un-neutralized acid groups in the base resin and component (c).

In the present invention, by using the above material to form the intermediate layer, the spin rate on shots with a W#1 can be lowered, enabling the ball to travel a longer distance.

The heated mixture of which the intermediate layer-forming material is primarily composed accounts for at least 50 wt %, preferably at least 60 wt %, and more preferably at least 70 wt %, of the overall weight of the intermediate layer.

The olefin in the above base resin, whether in component (a) or component (b), has a number of carbons which is preferably at least 2 but not more than 8, and more preferably not more than 6. Specific examples include ethylene, propylene, butene, pentene, hexene, heptene and octene. Ethylene is especially preferred.

Examples of unsaturated carboxylic acids include acrylic acid, methacrylic acid, maleic acid and fumaric acid. Acrylic acid and methacrylic acid are especially preferred.

Moreover, the unsaturated carboxylic acid ester is preferably a lower alkyl ester of the above unsaturated carboxylic acid. Specific examples include methyl methacrylate, ethyl methacrylate, propyl methacrylate, butyl methacrylate, methyl acrylate, ethyl acrylate, propyl acrylate and butyl acrylate. Butyl acrylate (n-butyl acrylate, i-butyl acrylate) is especially preferred.

The olefin-unsaturated carboxylic acid random copolymer of component (a) and the olefin-unsaturated carboxylic acid-unsaturated carboxylic acid ester random terpolymer of component (b) (the copolymers in components (a) and (b) are referred to collectively below as "random copolymers") may each be obtained by preparing the above-mentioned materials and carrying out random copolymerization by a known method.

It is recommended that the above random copolymers have unsaturated carboxylic acid contents (acid contents) that are controlled. Here, it is recommended that the content of unsaturated carboxylic acid present in the random copolymer serving as component (a) be generally at least 4 wt %, preferably at least 6 wt %, more preferably at least 8 wt %, and even more preferably at least 10 wt %, but generally not more than 30 wt %, preferably not more than 20 wt %, more preferably not more than 18 wt %, and even more preferably not more than 15 wt %.

Similarly, it is recommended that the content of unsaturated carboxylic acid present in the random copolymer serving as component (b) be generally at least 4 wt %, preferably at least 6 wt %, and more preferably at least 8 wt %, but generally not more than 15 wt %, preferably not more than 12 wt %, and more preferably not more than 10 wt %. If the acid content of the random copolymer is too low, the resilience may decrease, whereas if it is too high, the processability of the intermediate layer-forming resin material may decrease.

The metal ion neutralization product of the olefin-unsaturated carboxylic acid random copolymer of component (a) and the metal ion neutralization product of the olefin-unsaturated carboxylic acid-unsaturated carboxylic acid ester random terpolymer of component (b) (the metal ion neutralization products of the copolymers in components (a) and (b) are referred to collectively below as "metal ion neutralization products of the random copolymers") may be obtained by neutralizing some of the acid groups on the random copolymers with metal ions.

Illustrative examples of metal ions for neutralizing the acid groups include $Na^+$, $K^+$, $Li^+$, $Zn^{++}$, $Cu^{++}$, $Mg^{++}$, $Ca^{++}$, $Co^{++}$, $Ni^{++}$ and $Pb^{++}$. Of these, preferred use can be made of, for example, $Na^+$, $Li^+$, $Zn^{++}$ and $Mg^{++}$. To improve resilience, the use of $Na^+$ is even more preferred.

The above metal ion neutralization products of the random copolymers may be obtained by neutralizing the random copolymers with the foregoing metal ions. For example, use may be made of a method in which neutralization is carried out with a compound such as a formate, acetate, nitrate, carbonate, bicarbonate, oxide, hydroxide or alkoxide of the above-mentioned metal ions. No particular limitation is imposed on the degree of neutralization of the random copolymer by these metal ions.

Sodium ion-neutralized ionomer resins may be suitably used as the above metal ion neutralization products of random copolymers to increase the melt flow rate of the material. In this way, adjustment of the material to the subsequently described optimal melt flow rate is easy, enabling the moldability to be improved.

Commercially available products may be used as the base resins of above components (a) and (b). Illustrative examples of the random copolymer in component (a) include Nucrel 1560, Nucrel 1214 and Nucrel 1035 (all products of DuPont-Mitsui Polychemicals Co., Ltd.), and Escor 5200, Escor 5100 and Escor 5000 (all products of ExxonMobil Chemical). Illustrative examples of the random copolymer in component (b) include Nucrel AN4311 and Nucrel AN4318 (both products of DuPont-Mitsui Polychemicals Co., Ltd.), and Escor ATX325, Escor ATX320 and Escor ATX310 (all products of ExxonMobil Chemical).

Illustrative examples of the metal ion neutralization product of the random copolymer in component (a) include Himilan 1554, Himilan 1557, Himilan 1601, Himilan 1605, Himilan 1706 and Himilan AM7311 (all products of DuPont-Mitsui Polychemicals Co., Ltd.), Surlyn 7930 (E.I. DuPont de Nemours & Co.), and Iotek 3110 and Iotek 4200 (both products of ExxonMobil Chemical). Illustrative examples of the metal ion neutralization product of the random copolymer in component (b) include Himilan 1855, Himilan 1856 and Himilan AM7316 (all products of DuPont-Mitsui Polychemicals Co., Ltd.), Surlyn 6320, Surlyn 8320, Surlyn 9320 and Surlyn 8120 (all products of E.I. DuPont de Nemours & Co.), and Iotek 7510 and Iotek 7520 (both products of ExxonMobil Chemical). Sodium-neutralized ionomer resins that are suitable as the metal ion neutralization product of the random copolymer include Himilan 1605, Himilan 1601 and Himilan 1555.

When preparing the above-described base resin, component (a) and component (b) are admixed in a weight ratio of between 100:0 and 0:100, preferably between 100:0 and 25:75, more preferably between 100:0 and 50:50, even more preferably between 100:0 and 75:25, and most preferably 100:0. If too little component (a) is included, the molded material obtained therefrom may have a decreased resilience.

In addition, the processability of the base resin can be further improved by also adjusting the ratio in which the random copolymers and the metal ion neutralization products of the random copolymers are admixed when preparing the base resin as described above. It is recommended that the weight ratio of the random copolymers to the metal ion neutralization products of the random copolymers be generally between 0:100 and 60:40, preferably between 0:100 and 40:60, more preferably between 0:100 and 20:80, and even more preferably 0:100. The addition of too much random copolymer may lower the processability during mixing.

Component (e) described below may be added to the base resin. Component (e) is a non-ionomeric thermoplastic elastomer. The purpose of this component is to further improve both the feel of the ball on impact and the rebound. Examples include olefin elastomers, styrene elastomers, polyester elastomers, urethane elastomers and polyamide elastomers. To further increase the rebound, it is preferable to use a polyester elastomer or an olefin elastomer. The use of an olefin elastomer composed of a thermoplastic block copolymer which includes crystalline polyethylene blocks as the hard segments is especially preferred.

A commercially available product may be used as component (e). Illustrative examples include Dynaron (JSR Corporation) and the polyester elastomer Hytrel (DuPont-Toray Co., Ltd.).

It is recommended that component (e) be included in an amount, per 100 parts by weight of the base resin of the invention, of preferably at least 0 part by weight, more preferably at least 5 parts by weight, even more preferably at least 10 parts by weight, and most preferably at least 20 parts by weight, but preferably not more than 100 parts by weight, more preferably not more than 60 parts by weight, even more preferably not more than 50 parts by weight, and most preferably not more than 40 parts by weight. Too much component (e) will lower the compatibility of the mixture, possibly resulting in a substantial decline in the durability of the golf ball.

Next, component (c) described below may be added to the base resin. Component (c) is a fatty acid or fatty acid derivative having a molecular weight of at least 228 but not more than 1500. Compared with the base resin, this component has a very low molecular weight and, by suitably adjusting the melt viscosity of the mixture, helps in particular to improve the flow properties. Component (c) includes a relatively high content of acid groups (or derivatives thereof), and is capable of suppressing an excessive loss in resilience.

The fatty acid or fatty acid derivative of component (c) has a molecular weight of at least 228, preferably at least 256, more preferably at least 280, and even more preferably at least 300, but not more than 1500, preferably not more than 1000, even more preferably not more than 600, and most preferably not more than 500. If the molecular weight is too low, the heat resistance cannot be improved. On the other hand, if the molecular weight is too high, the flow properties cannot be improved.

The fatty acid or fatty acid derivative of component (c) may be an unsaturated fatty acid (or derivative thereof) containing a double bond or triple bond on the alkyl moiety, or it may be a saturated fatty acid (or derivative thereof) in which the bonds on the alkyl moiety are all single bonds. It is recommended that the number of carbons on the molecule be preferably at least 18, more preferably at least 20, even more preferably at least 22, and most preferably at least 24, but preferably not more than 80, more preferably not more than 60, even more preferably not more than 40, and most preferably not more than 30. Too few carbons may make it impossible to improve the heat resistance and may also make the acid group content so high as to diminish the flow-improving effect due to interactions with acid groups present in the base resin. On the other hand, too many carbons increases the molecular weight, which may keep a distinct flow-improving effect from appearing.

Specific examples of the fatty acid of component (c) include myristic acid, palmitic acid, stearic acid, 12-hydroxystearic acid, behenic acid, oleic acid, linoleic acid, linolenic acid, arachidic acid and lignoceric acid. Of these, stearic acid, arachidic acid, behenic acid and lignoceric acid are preferred. Behenic acid is especially preferred.

The fatty acid derivative of component (c) is exemplified by metallic soaps in which the proton on the acid group of the fatty acid has been replaced with a metal ion. Examples of the metal ion include $Na^{+}$, $Li^{+}$, $Ca^{++}$, $Mg^{++}$, $Zn^{++}$, $Mn^{++}$, $Al^{+++}$, $Ni^{++}$, $Fe^{++}$, $Fe^{+++}$, $Cu^{++}$, $Sn^{++}$, $Pb^{++}$ and $Co^{++}$. Of these, $Ca^{++}$, $Mg^{++}$ and $Zn^{++}$ are especially preferred.

Specific examples of fatty acid derivatives that may be used as component (c) include magnesium stearate, calcium stearate, zinc stearate, magnesium 12-hydroxystearate, calcium 12-hydroxystearate, zinc 12-hydroxystearate, magnesium arachidate, calcium arachidate, zinc arachidate, magnesium behenate, calcium behenate, zinc behenate, magnesium lignocerate, calcium lignocerate and zinc lignocerate. Of these, magnesium stearate, calcium stearate, zinc stearate, magnesium arachidate, calcium arachidate, zinc arachidate, magnesium behenate, calcium behenate, zinc behenate, magnesium lignocerate, calcium lignocerate and zinc lignocerate are preferred.

Component (d) may be added as a basic inorganic metal compound capable of neutralizing acid groups in the base resin and in component (c). If component (d) is not included, when a metal soap-modified ionomer resin (e.g., the metal soap-modified ionomer resins mentioned in the above-cited patent publications) is used alone, the metallic soap and un-neutralized acid groups present on the ionomer resin undergo exchange reactions during mixture under heating, generating a large amount of fatty acid. Because the fatty acid has a low thermal stability and readily vaporizes during molding, it may cause molding defects. Moreover, if the fatty acid thus generated deposits on the surface of the molded material, it may substantially lower paint film adhesion and may have other undesirable effects such as lowering the resilience of the resulting molded material.

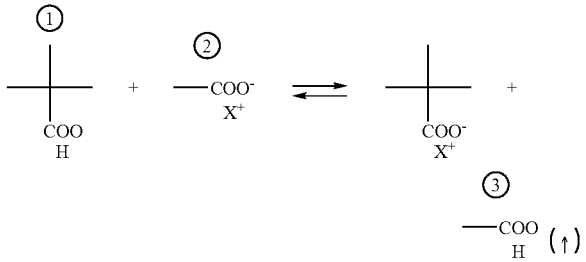

(1) un-neutralized acid group present on the ionomer resin
(2) metallic soap
(3) fatty acid
X: metal cation Accordingly, to solve this problem, the intermediate layer-forming resin material includes also, as an essential component, a basic inorganic metal compound (d) which neutralizes the acid groups present in the base resin and component (c), in this way improving the resilience of the molded material.

That is, by including component (d) as an essential ingredient in the material, not only are the acid groups in the base resin and component (c) neutralized, through synergistic effects from the optimal addition of each of these components it is possible as well to increase the thermal stability of the mixture and give it a good moldability, and also to enhance the resilience.

Here, it is recommended that the basic inorganic metal compound used as component (d) be a compound which has a high reactivity with the base resin and contains no organic acids in the reaction by-products, thus enabling the degree of neutralization of the mixture to be increased without a loss of thermal stability.

Illustrative examples of the metal ion in the basic inorganic metal compound serving as component (d) include $Li^{+}$, $Na^{+}$, $K^{+}$, $Ca^{++}$, $Mg^{++}$, $Zn^{++}$, $Al^{+++}$, $Ni^{++}$, $Fe^{++}$, $Fe^{+++}$, $Cu^{++}$, $Mn^{++}$, $Sn^{++}$, $Pb^{++}$ and $Co^{++}$. Known basic inorganic fillers containing these metal ions may be used as the basic inorganic metal compound. Specific examples include magnesium oxide, magnesium hydroxide, magnesium carbonate, zinc oxide, sodium hydroxide, sodium carbonate, calcium oxide, calcium hydroxide, lithium hydroxide and lithium carbonate. In particular, a hydroxide or a monoxide is recommended. Calcium hydroxide and magnesium oxide, which have a high reactivity with the base resin, are more preferred. Calcium hydroxide is especially preferred.

Because the above-described resin material is arrived at by blending specific respective amounts of components (c) and (d) with the resin component, i.e., the base resin containing specific respective amounts of components (a) and (b) in combination with optional component (e), this material has excellent thermal stability, flow properties and moldability, and can impart the molded material with a markedly improved resilience.

Components (c) and (d) are included in respective amounts, per 100 parts by weight of the resin component suitably formulated from components (a), (b) and (e), of at least 5 parts by weight, preferably at least 10 parts by weight, more preferably at least 15 parts by weight, and even more preferably at least 18 parts by weight, but not more than 150 parts by weight, preferably not more than 130 parts by weight, and more preferably not more than 120 parts by weight, of component (c); and at least 0.1 part by weight, preferably at least 0.5 part by weight, more preferably at least 1 part by weight, and even more preferably at least 2 parts by weight, but not more than 17 parts by weight, preferably not more than 15 parts by weight, more preferably not more than 13 parts by weight, and even more preferably not more than 10 parts by weight, of component (d). Too little component (c) lowers the melt viscosity, resulting in inferior processability, whereas too much lowers the durability. Too little component (d) fails to improve thermal stability and resilience, whereas too much instead lowers the heat resistance of the golf ball-forming material due to the presence of excess basic inorganic metal compound.

In the above-described resin material formulated from the respective above-indicated amounts of the resin component and components (c) and (d), it is recommended that at least 50 mol %, preferably at least 60 mol %, more preferably at least 70 mol %, and even more preferably at least 80 mol %, of the acid groups be neutralized. Such a high degree of neutralization makes it possible to more reliably suppress the exchange reactions that cause trouble when only a base resin and a fatty acid or fatty acid derivative are used as in the above-cited prior art, thus preventing the generation of fatty acid. As a result, there is obtained a resin material of substantially improved thermal stability and good processability which can provide molded products of much better resilience than prior-art ionomer resins.

"Degree of neutralization," as used above, refers to the degree of neutralization of acid groups present within the mixture of the base resin and the fatty acid or fatty acid derivative serving as component (c), and differs from the degree of neutralization of the ionomer resin itself when an ionomer resin is used as the metal ion neutralization product of a random copolymer in the base resin. A mixture according to the invention having a certain degree of neutralization, when compared with an ionomer resin alone having the same degree of neutralization, contains a very large number of metal ions. This large number of metal ions increases the density of ionic crosslinks which contribute to improved resilience, making it possible to confer the molded product with excellent resilience.

To more reliably achieve both a high degree of neutralization and good flow properties, use may be made of a material in which the acid groups in the above-described mixture have been neutralized with transition metal ions and with alkali metal and/or alkaline earth metal ions. Although neutralization with transition metal ions results in a weaker ionic cohesion than neutralization with alkali metal and alkaline earth metal ions, by using these different types of ions together to neutralize acid groups in the mixture, a substantial improvement can be made in the flow properties.

It is recommended that the molar ratio between the transition metal ions and the alkali metal and/or alkaline earth metal ions be in a range of typically 10:90 to 90:10, preferably 20:80 to 80:20, more preferably 30:70 to 70:30, and even more preferably 40:60 to 60:40. Too low a molar ratio of transition metal ions may fail to provide a sufficient flow-improving effect. On the other hand, a transition metal ion molar ratio which is too high may lower the resilience.

Examples of the metal ions include, but are not particularly limited to, zinc ions as the transition metal ions and at least one type of ion selected from among sodium, lithium and magnesium ions as the alkali metal or alkaline earth metal ions.

A known method may be used to obtain a mixture in which the desired amount of acid groups have been neutralized with transition metal ions and alkali metal or alkaline earth metal ions. Specific examples of methods of neutralization with transition metal ions, particularly zinc ions, include a method which uses a zinc soap as the fatty acid derivative, a method which uses a zinc ion neutralization product (e.g., a zinc ion-neutralized ionomer resin) when formulating components (a) and (b) as the base resin, and a method which uses a zinc compound such as zinc oxide as the basic inorganic metal compound of component (d).

The resin material should preferably have a melt flow rate adjusted to ensure flow properties that are particularly suitable for injection molding, and thus improve moldability. Specifically, it is recommended that the melt flow rate (MFR), as measured according to JIS-K7210 at a temperature of 190° C. and under a load of 21.18 N (2.16 kgf), be set to preferably at least 0.5 dg/min, more preferably at least 0.7 dg/min, even more preferably at least 0.8 dg/min, and most preferably at least 2 dg/min, but preferably not more than 20 dg/min, more preferably not more than 10 dg/min, even more preferably not more than 5 dg/min, and most preferably not more than 3 dg/min. Too high or low a melt flow rate may result in a substantial decline in processability.

Illustrative examples of the envelope layer material include those having the trade names HPF 1000, HPF 2000, HPF AD1027, HPF AD1035 and HPF AD1040, as well as the experimental material HPF SEP1264-3, all produced by DuPont K.K.

The intermediate layer must have a Shore D hardness of at least 40 but not more than 60. The lower limit is preferably at least 43, and more preferably at least 45. The upper limit is preferably not more than 60, more preferably not more than 57, and even more preferably not more than 55. At a Shore D value outside of the above hardness range for the intermediate layer, the spin rate of the ball tends to increase, as a result of which the distance traveled by the ball may decrease.

The intermediate layer must have a thickness of at least 1.7 mm but not more than 4.0 mm, and preferably has a thickness of at least 2.2 mm but not more than 3.5 mm. By optimizing the thickness of the intermediate layer in this way, a sphere composed in part of the intermediate layer is able to manifest a sufficient degree of resilience, in addition to which the spin rate of the ball is suppressed, enabling the distance traveled by the ball to be increased.

A sphere composed of the core encased by the intermediate layer has a deflection, when compressed under a final load of 130 kgf from an initial load of 10 kgf, which, while not subject to any particular limitation, is preferably at least 2.5 mm, and more preferably at least 3.0 mm, but preferably not more than 4.0 mm, and even more preferably 3.6 mm.

Letting the core have a deflection (I) when compressed under a final load of 130 kgf from an initial load of 10 kgf, and letting the sphere composed of the core encased by the intermediate layer have a deflection (II) when compressed under a final load of 130 kgf from an initial load of 10 kgf, the ratio II/I has a value of preferably at least 0.7, more preferably at least 0.75, and even more preferably at least 0.8, but preferably not more than 0.93, more preferably not more than 0.92, and even more preferably not more than 0.90. At a II/I value higher than the above range, the spin rate of the ball when hit with a driver may increase, shortening the distance traveled by the ball. On the other hand, at a II/I value smaller than the above range, a sufficient resilience may not be attained and the spin rate may increase.

In the golf ball of the invention, the initial velocity defined for a golf ball, while not subject to any particular limitation, preferably satisfies the following condition:

(initial velocity of core)<(initial velocity of sphere composed of core encased by intermediate layer).

By thus having the initial velocity of the sphere composed of a core encased by the intermediate layer be larger than the initial velocity of the core itself, it is possible to lower the spin rate of the ball as a whole. The above difference, expressed as (initial velocity of sphere composed of core encased by intermediate layer)−(initial velocity of core), is preferably at least 0.05, more preferably at least 0.1, and even more preferably at least 0.2. The means for satisfying such a condition in the present invention is to use a highly resilient material as the intermediate layer. In addition, making the intermediate layer harder and having the core be softer and of a lower resilience also help to satisfy the above condition, although the objects of the invention cannot be achieved without at the same time satisfying the other conditions specified in the present invention.

The initial velocity mentioned above is measured using an initial velocity measuring apparatus of the same type as the USGA drum rotation-type initial velocity instrument approved by the R&A. The ball is temperature-conditioned for at least 3 hours in a 23±1° C. environment, then tested in a room-temperature (23±2° C.) chamber by being hit with a 250-pound (113.4 kg) head (striking mass) at an impact velocity of 143.8 ft/s (43.83 m/s). A dozen balls are each hit four times. The time taken to traverse a distance of 6.28 ft (1.91 m) is measured and used to compute the initial velocity (m/s) of the ball. This cycle is carried out over a period of about 15 minutes.

The cover is an outer layer encasing the above-described core and intermediate layer, and has a plurality of dimples formed on an outside surface thereof. The cover is not limited to a single layer, and may be formed of a plurality of layers. The cover is preferably formed primarily of any of various types of resin materials. The use of an ionomer resin, particularly an ionomer resin neutralized with zinc ions ($Zn^{++}$), is preferred. By using such a material, the scuff resistance of the golf ball can be improved and the durability can also be improved.

The cover has a hardness, expressed as the Shore D hardness, of preferably at least 50, more preferably at least 53, and even more preferably at least 55, but preferably not more than 65, more preferably not more than 63, and even more preferably not more than 59.

The cover has a thickness which, while not subject to any particular limitation, is preferably at least 0.5 mm, and more preferably at least 1.0 mm, but preferably not more than 2.0 mm, and even more preferably not more than 1.7 mm.

As is the case with methods of molding covers for conventional golf balls, any of various known methods, such as injection molding and compression molding, may be used to form the above-described intermediate layer and cover. The intermediate layer and cover may be easily formed by suitably selecting conditions such as the injection temperature and time from commonly used ranges.

In the present invention, by setting the number of dimples formed on the surface of the ball to at least 272, preferably at least 296, and more preferably at least 316, but not more than 348, preferably not more than 342, and even more preferably not more than 336, a high lift is achieved on the ball trajectory, enabling the ball to travel a longer distance. Although the number of dimples on the inventive golf ball is set to a relatively small number compared with the number of dimples on a conventional golf ball, an aerodynamic performance in keeping with the amount of spin provided by the internal construction of the ball can be achieved, enabling the distance traveled by the ball to be improved.

The dimples formed on the surface of the ball have a surface coverage which, while not subject to any particular limitation, is preferably at least 75% for reasons having to do with the aerodynamic performance.

The dimples may have any of various shapes, such as circular, polygonal, teardrop and oval shapes, without particular limitation. Nor is any particular limitation imposed on the proximity between neighboring dimples. However, because an interval (land width) between neighboring dimples of substantially 0 results in a higher surface coverage, the dimples may be designed in this way. In addition, because the surface coverage can be increased by intermingling dimples of differing sizes on the surface of the ball, the dimples may be designed in this way. Alternatively, it is desirable to use a combination of dimples having contour lengths of from 7 to 20 mm, in addition to which dimples of the same shape but differing depths may be used in admixture. To provide symmetry, the number of dimple types formed on the ball surface may be set to five or more. A specific embodiment for providing symmetry may involve forming dimples to a depth of from 5 to 50 μm on and in the vicinity of the line on the ball that corresponds to the parting line between mold halves.

Figure 4:
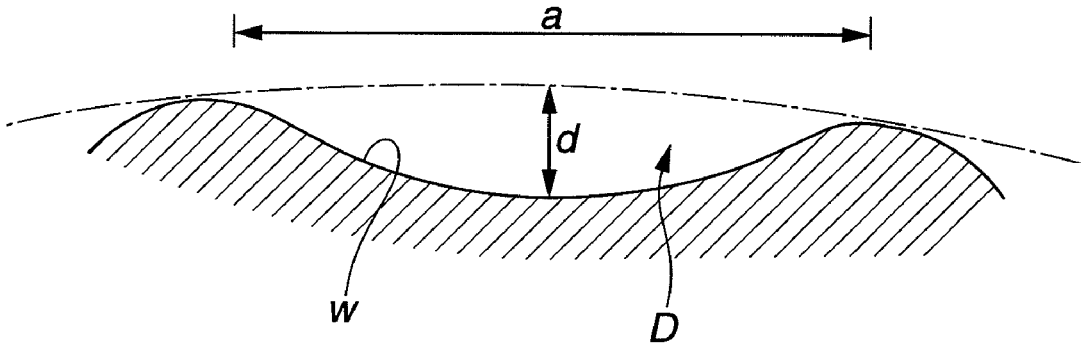
FIG. 4 is an enlarged cross-sectional view of a dimple according to the present invention.

To fully achieve the objects of the invention, the total volume of the dimples, while not subject to any particular limitation, is set in a range of preferably from 400 to 700 $mm^3$, and more preferably from 450 to 650 $mm^3$. The total volume of the dimples is determined by computing the volume of each dimple from the dimple depth, defined for each dimple as the distance from the spherical surface of the ball were it to have no dimples to the bottom of the dimple, and the dimple diameter. That is, referring to FIG. 4, the volume of a single dimple is the volume of the region enclosed by the wall w of the dimple D and the curved surface of land areas on the ball (indicated in the diagram by the dash-dot line), and the total dimple volume refers to the sum of the individual dimple volumes. In the diagram, the dimple diameter is denoted by the reference symbol a, and the dimple depth is denoted by the reference symbol d.

The completed golf ball (golf ball having dimples) has a deflection, when compressed under a final load of 130 kgf from an initial load of 10 kg, of preferably at least 2.5 mm, and more preferably at least 2.7 mm, but preferably not more than 3.5 mm, and more preferably not more than 3.3 mm.

As explained above, golf balls according to the present invention are able to travel farther owing to the combination of dimples which do not lose lift in the low-velocity, low-spin region of the ball trajectory with a low-spin ball construction. Moreover, the inventive balls have a good scuff resistance and durability. Accordingly, the golf balls of the invention are beneficial for competitive use by highly skilled golfers and amateur golfers.

EXAMPLES

Examples of the invention and Comparative Examples are given below by way of illustration, and not by way of limitation.

Examples 1 to 4, Comparative Examples 1 to 5

Cores for the respective examples of the invention and comparative examples were produced by blending suitable amounts of an organic peroxide, an antioxidant, zinc oxide, zinc acrylate and an organosulfur compound (diphenylsulfide or the zinc salt of pentachlorothiophenol) in polybutadiene having the trade name BR 730 (available from JSR Corporation) as the base rubber, then vulcanizing the blend under applied heat at 155° C. for 15 minutes. The properties of the resulting core are shown in Table 2 below.

A cover and an intermediate layer were successively injection-molded over the core in each example using the material A, B, C and D formulations described below. During injection-molding of the cover, dimples were formed in a given pattern on the surface of the cover by means of dimple-forming projections within the mold cavity for creating a given arrangement of dimples. Details of the dimples are given in Table 1 and shown in FIGS. 2 and 3.

Material A Formulation

Produced by DuPont K.K. under the trade name HPF 1000. A terpolymer composed of about 75 to 76 wt % of ethylene, about 8.5 wt % of acrylic acid, and about 15.5 to 16.5 wt % of n-butyl acrylate. All (100%) of the acid groups were neutralized with magnesium ions.

Material B Formulation

Prepared by blending 20 parts by weight of behenic acid, 2.9 parts by weight of calcium hydroxide and 0.3 part by weight of blue pigment with 100 parts by weight of a base resin composed of 85 wt % of Himilan AM7331 (trade name; produced by DuPont-Mitsui Polychemicals Co., Ltd.) and 15 wt % of Dynaron 6100P (trade name; produced by JSR Corporation).

Material C Formulation

Prepared by blending Himilan 1557 and Himilan 1855 (both produced by DuPont-Mitsui Polychemicals under these trade names) in a 50:50 weight ratio.

Material D Formulation

Prepared by blending 4 parts by weight of titanium oxide and 1 part by weight of magnesium stearate with a base resin prepared from Surlyn 6320, Surlyn 7930 and Nucrel 9-1 (all produced under these trade names by E.I. DuPont de Nemours and Co.) in a weight ratio of 35:60:5.

TABLE 1

| | No. | Number of dimples | Diameter (mm) | Contour length (mm) | Depth (mm) | Volume ($mm^3$) | Total number | Total volume ($mm^3$) | Surface coverage (%) |
|---|---|---|---|---|---|---|---|---|---|
| Dimple I | No. 1 | 12 | 4.60 | 14.5 | 0.27 | 2.205 | 330 | 568 | 81 |
| | No. 2 | 234 | 4.40 | 13.8 | 0.26 | 1.937 | | | |
| | No. 3 | 60 | 3.80 | 11.9 | 0.22 | 1.227 | | | |
| | No. 4 | 12 | 3.50 | 11.0 | 0.20 | 0.934 | | | |
| | No. 5 | 12 | 2.50 | 7.9 | 0.14 | 0.321 | | | |
| Dimple II | No. 1 | 288 | 3.90 | 12.3 | 0.24 | 1.376 | 432 | 508 | 80 |
| | No. 2 | 60 | 3.80 | 11.9 | 0.23 | 1.280 | | | |
| | No. 3 | 12 | 2.90 | 9.1 | 0.18 | 0.566 | | | |
| | No. 4 | 60 | 2.40 | 7.5 | 0.13 | 0.289 | | | |
| | No. 5 | 12 | 3.40 | 10.7 | 0.21 | 0.905 | | | |

Figure 2:
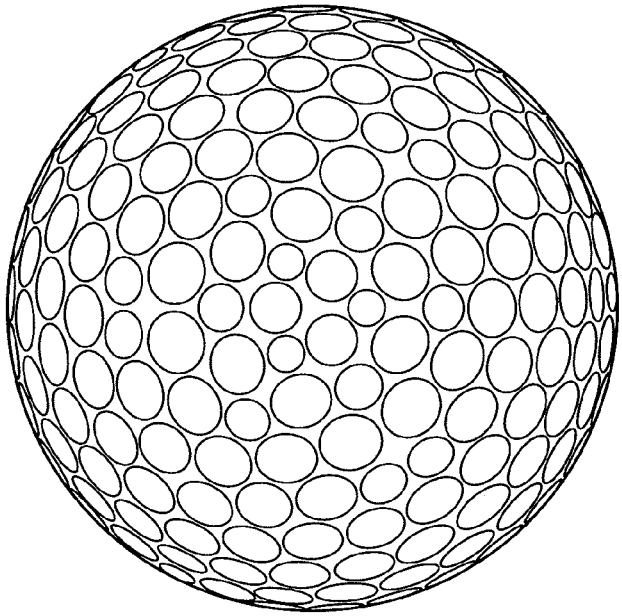
FIG. 2 is a top view of a golf ball showing the arrangement of dimples used in the examples of the invention.
Figure 3:
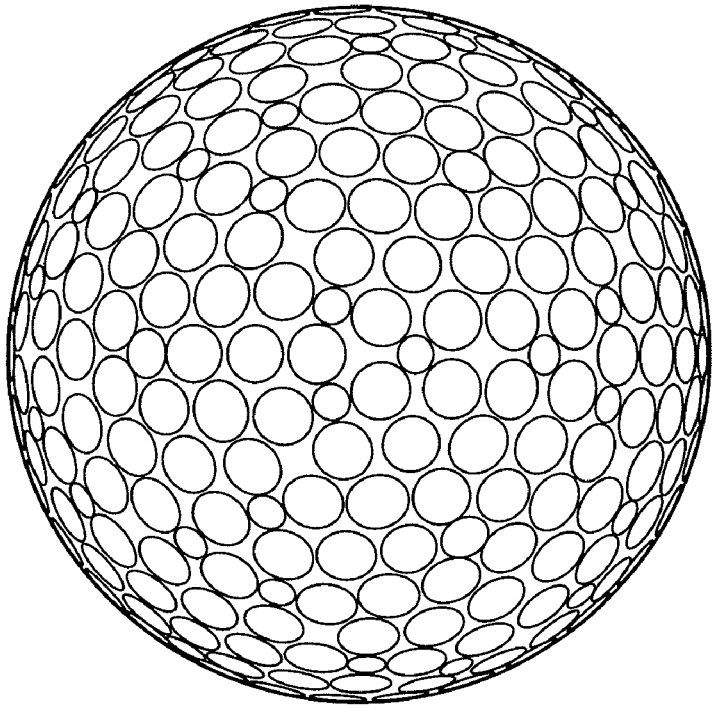
FIG. 3 is a top view of a golf ball showing the arrangement of dimples used in the comparative examples.

Note:
The Dimple I arrangement is shown in FIG. 2, and the Dimple II arrangement is shown in FIG. 3. The dimple volume was computed from the dimple depth, measured from the spherical surface of the ball were it to have no dimples to the bottom of the dimple, and the dimple diameter.

TABLE 2

| | | Example | | | | Comparative Example | | | | |
|---|---|---|---|---|---|---|---|---|---|---|
| | | 1 | 2 | 3 | 4 | 1 | 2 | 3 | 4 | 5 |
| Core | Diameter (mm) | 35 | 34.2 | 34 | 33.8 | 37.7 | 37.3 | 34.2 | 35 | 35 |
| | Center hardness (JIS-C) | 60 | 61 | 60 | 59 | 61 | 63 | 61 | 60 | 60 |
| | Surface hardness (JIS-C) | 79 | 78 | 77 | 77 | 80 | 80 | 78 | 79 | 79 |
| | Hardness difference (surface – center) | 19 | 17 | 17 | 18 | 19 | 17 | 17 | 19 | 19 |
| | Deflection A (mm) | 3.9 | 3.9 | 4 | 4 | 3.5 | 3.5 | 3.8 | 3.9 | 3.9 |
| | Initial velocity X (m/s) | 77.2 | 77.4 | 77.5 | 77.5 | 77.9 | 77.4 | 77.4 | 77.2 | 77.2 |
| Intermediate layer | Type | A | A | A | A | B | A | B | A | A |
| | Gauge (mm) | 2.6 | 3.0 | 3.1 | 3.2 | 1.25 | 1.45 | 3.0 | 2.6 | 2.6 |
| | Shore D hardness | 51 | 51 | 51 | 51 | 51 | 51 | 51 | 51 | 51 |
| | Deflection B (mm) | 3.3 | 3.3 | 3.4 | 3.4 | 3.3 | 3.3 | 3.3 | 3.3 | 3.3 |
| | Initial velocity Y (m/s) | 77.8 | 77.8 | 77.8 | 77.8 | 77.8 | 77.7 | 77.2 | 77.8 | 77.8 |
| Cover | Type | C | C | C | C | C | C | C | D | C |
| | Gauge (mm) | 1.25 | 1.25 | 1.25 | 1.25 | 1.25 | 1.25 | 1.25 | 1.25 | 1.25 |
| | Shore D hardness | 56 | 56 | 56 | 56 | 56 | 56 | 56 | 57 | 56 |
| | Outer diameter (mm) | 42.70 | 42.70 | 42.70 | 42.70 | 42.70 | 42.70 | 42.70 | 42.70 | 42.70 |
| | Hardness of finished ball (mm) | 3 | 3 | 3 | 3 | 3 | 3 | 3 | 3 | 3 |
| | Y – X | 0.6 | 0.4 | 0.3 | 0.3 | −0.1 | 0.3 | −0.2 | 0.1 | 0.6 |
| | B/A | 0.85 | 0.85 | 0.85 | 0.85 | 0.94 | 0.94 | 0.87 | 0.89 | 0.85 |
| Dimples | | I | I | I | I | I | I | I | I | II |
| Spin on shots with W#1 (rpm) | | 2550 | 2500 | 2550 | 2600 | 2800 | 2700 | 2800 | 2550 | 2550 |
| Total distance (m) | | 235 | 233 | 234 | 233 | 230 | 230 | 223 | 235 | 230 |
| Scuff resistance | | good | good | good | good | good | good | good | NG | good |

(1) Core Deflection (A) and Sphere Deflection (B)

The core was placed on a hard plate, and the deflection (mm) when compressed under a final load of 1,275 N (130 kgf) from an initial load of 98 N (10 kgf) was measured.

(2) Center Hardness and Surface Hardness of Core

The center hardness of the core was determined by cutting a core sphere in half, placing the indenter at the center of the cut face, and measuring the JIS-C hardness (in accordance with JIS-K6301).

To determine the surface hardness of the core, the durometer indenter was set substantially perpendicular to the spherical surface of the core, and JIS-C hardness measurements (in accordance with JIS-K6301) were taken at two randomly selected points on the core surface. The average of the two measurements was used as the core surface hardness.

(3) Hardness of Intermediate Layer Material

The Shore D hardness was measured in accordance with ASTM D-2240.

(4) Hardness of Cover Material

The same measurement method was used as in (3) above.

(5) Initial Velocity of Core (X) and Initial Velocity of Sphere (Y)

The initial velocity of the core (X) and the initial velocity of a sphere composed of the core encased by the intermediate layer (Y) were measured using an initial velocity measuring apparatus of the same type as the USGA drum rotation-type initial velocity instrument approved by the R&A. The ball was temperature-conditioned for at least 3 hours in a 23±1° C. environment, then tested in a room-temperature (23±2° C.) chamber by being hit with a 250-pound (113.4 kg) head (striking mass) at an impact velocity of 143.8 ft/s (43.83 m/s). A dozen balls were each hit four times. The time taken to traverse a distance of 6.28 ft (1.91 m) was measured and used to compute the initial velocity (m/s) of the ball. This cycle was carried out over a period of about 15 minutes.

(6) Flight Performance

The carry and total distance of the ball when hit at a head speed (HS) of 40 m/s with a club (X-Drive, manufactured by Bridgestone Sports Co., Ltd.; loft angle, 10.5°) mounted on a swing robot were measured. The results were rated according to the criteria shown below. The spin rate was the value measured for the ball immediately following impact, using an apparatus for measuring initial conditions.

(7) Scuff Resistance

A non-plated pitching sand wedge was mounted on a swing robot and the ball was hit once at a head speed of 40 m/s, following which the surface state of the ball was visually examined and rated as follows.

Good: Can be used again

NG: Cannot be used again

Based on the results in Table 2, the balls obtained in the comparative examples were inferior in the following ways to the balls obtained in the examples of the invention.

In Comparative Example 1, the intermediate layer was thin and had a low rebound resilience, making it impossible to lower the spin rate and thus resulting in a shorter distance of travel. Because the initial velocity of the core was higher than the initial velocity of the sphere (combination of core and intermediate layer), a further reduction in the spin rate could not be achieved. In Comparative Example 2, the intermediate layer was thin; hence, the spin rate could not be reduced, as a result of which the distance traveled by the ball decreased. In Comparative Example 3, because the sphere (core/intermediate layer) had an inadequate resilience, the spin rate could not be reduced, resulting in a shorter distance of travel. In Comparative Example 4, a zinc ion-type ionomer resin was not used as the cover material, resulting in a poor scuff resistance. In Comparative Example 5, because the dimple construction specified in the present invention was not used, the desired aerodynamic properties were not obtained, resulting in a shorter distance of travel.

The invention claimed is:

1. A golf ball comprising a core, a cover having a plurality of dimples on an outside surface thereof, and an intermediate layer disposed between the core and the cover, wherein the core has a deflection, when compressed under a final load of 130 kgf from an initial load of 10 kgf, of at least 3.0 mm but not more than 5.0 mm; the intermediate layer is formed of a material composed primarily of a heated mixture of:

100 parts by weight of a resin component composed of, in admixture, a base resin of (a) an olefin-unsaturated carboxylic acid random copolymer and/or a metal ion neutralization product of an olefin-unsaturated carboxylic acid random copolymer mixed with (b) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in a weight ratio between 100:0 and 0:100, and (e) a non-ionomeric thermoplastic elastomer in a weight ratio between 100:0 and 50:50;

(c) 5 to 150 parts by weight of a fatty acid and/or fatty acid derivative having a molecular weight of from 228 to 1500; and (d) 0.1 to 17 parts by weight of a basic inorganic metal compound capable of neutralizing un-neutralized acid groups in the base resin and component (c);

the intermediate layer has a Shore D hardness of at least 40 but not more than 60, and has a thickness of at least 3.1 mm but not more than 4.0 mm; and the number of dimples is at least 272 but not more than 348, and wherein the cover is formed of a resin material which is an ionomer resin neutralized with zinc ions, and 100 mol % of the acid groups in the base resin and component (c) are neutralized.

2. The golf ball of claim 1 which has initial velocity characteristics, as defined by the Rules of Golf, that satisfy the following condition:

(initial velocity of the core)>(initial velocity of a sphere composed of the core encased by the intermediate layer).

3. The golf ball of claim 1, wherein the intermediate layer has a thickness of from 3.1 to 3.5 mm.

4. The golf ball of claim 1, wherein the core has a deflection (I) when compressed under a final load of 130 kgf from an initial load of 10 kgf and a sphere composed of core encased by the intermediate layer has a deflection (II) when compressed under a final load of 130 kgf from an initial load of 10 kgf such that the ratio II/I<0.9.

5. The golf ball of claim 1, wherein at least 85 mol % of the acid groups in the heated mixture used in the intermediate layer-forming material are neutralized with metal ions.

6. The golf ball of claim 1, wherein the core has a surface hardness of a JIS-C hardness value of at least 60 but not more than 85, and a center hardness of a JIS-C hardness value of at least 50 but not more than 65, and the difference therebetween (core surface hardness−core center hardness), in terms of JIS-C hardness values, is at least 5 but not more than 30.

7. The golf ball of claim 4, wherein the deflection (I) is at least 3.0 mm but not more than 5.0 mm and the deflection (II) is at least 2.5 mm but not more than 4.0 mm.

8. The golf ball of claim 1, wherein the cover has a thickness of at least 0.5 mm but not more than 2.0 mm.

* * * * *